United States Patent [19]

Kato et al.

[11] 4,009,698

[45] Mar. 1, 1977

[54] INTERNAL COMBUSTION ENGINE OF IGNITION TIMING CONTROLLABLE TYPE

[75] Inventors: Takashi Kato; Eishi Oono; Toshihiko Nakamura, all of Susono, Japan

[73] Assignee: Toyota Jidosha Kogyo Kabushiki Kaisha, Toyota, Japan

[22] Filed: Oct. 16, 1975

[21] Appl. No.: 622,903

[30] Foreign Application Priority Data

July 22, 1975 Japan ..... 50-88873

[52] U.S. Cl. ..... 123/117 A

[51] Int. Cl.[2] ..... F02P 5/10

[58] Field of Search ..... 123/117 A

[56] References Cited

UNITED STATES PATENTS

| | | | |
|---|---|---|---|
| 3,793,833 | 2/1974 | van Basshuysen | 123/117 A |
| 3,800,758 | 4/1974 | Sutherland | 123/117 A |

*Primary Examiner*—Alan Cohan

*Attorney, Agent, or Firm*—Stevens, Davis, Miller & Mosher

[57] ABSTRACT

Herein disclosed is an internal combustion engine of ignition timing controllable type for use with an automotive vehicle. The internal combustion engine includes, as customary, an intake system including a carburetor having a throttle valve, a distributor, and an ignition timing regulating device connected to the distributor and having a diaphragm chamber to which a control vacuum is supplied. The internal combustion engine further includes a first port from which a carburetor vacuum having relationship to the opening of the throttle valve is taken out, a second port from which an intake vacuum is taken out, and a first direction control valve operable in relationship to the speed of rotation of the internal combustion engine or to the running speed of the automotive vehicle. The first and second ports are selectively connected to the diaphragm chamber of the ignition timing regulating device by way of the first direction control valve, so that during a low speed driving condition of the engine the intake vacuum taken out from the second port may be supplied to the diaphragm chamber to retard the ignition timing, so that during a high speed driving condition of the internal combustion engine a low carburetor vacuum taken out from the first-named port may be supplied to said diaphragm chamber to advance the ignition timing, and so that upon deceleration from a high speed driving condition a high carburetor vacuum taken out from the first port may be supplied to the diaphragm chamber to retard the ignition timing.

4 Claims, 1 Drawing Figure

FIGURE
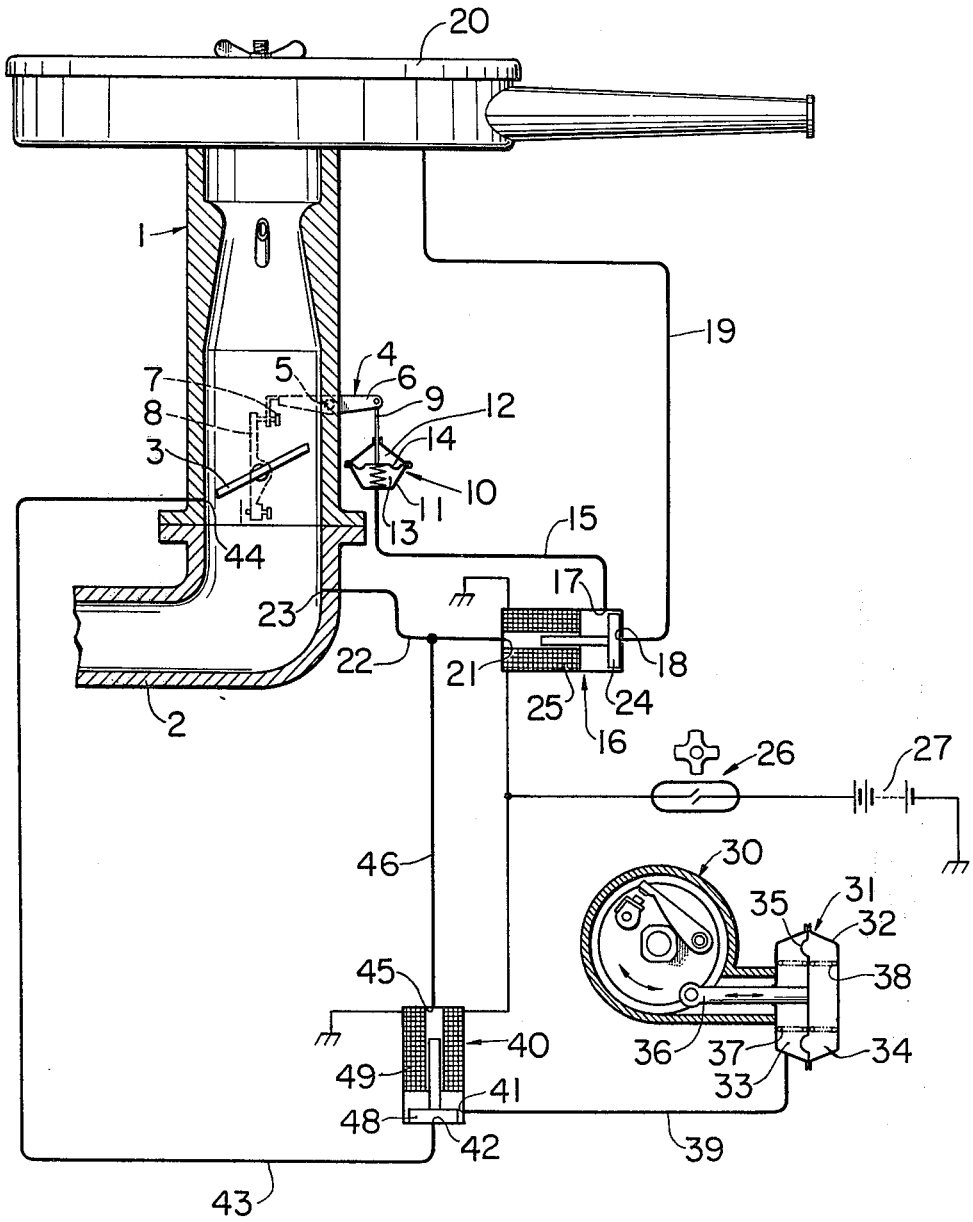

INTERNAL COMBUSTION ENGINE OF IGNITION TIMING CONTROLLABLE TYPE

BACKGROUND OF THE INVENTION

The present invention relates to an internal combustion engine, which comprises an intake system including a carburetor having a throttle valve, a distributor and an ignition timing regulating device connected to the distributor.

In an internal combustion engine, it is desirable to retard the ignition timing during its low speed driving condition so as to reduce the noxious content, such as, CO, HC and $NO_x$ in the engine exhaust gases. During a high speed driving condition, however, it is desirable to advance the ignition timing so as to increase the output power.

If, on the other hand, the ignition timing is retarded upon deceleration from a high speed driving condition, it is possible to strengthen the braking effect on the engine.

SUMMARY OF THE INVENTION

It is, therefore, an object of the present invention to provide an internal combustion engine which can enjoy a sufficient braking force on the engine upon deceleration from a high speed driving condition while insuring increase in the output power during a high speed driving condition.

Another object of the present invention is to provide an internal combustion engine of the above type, which includes a valve opening maintaining device adapted to maintain during deceleration the opening of the throttle valve of a carburetor higher than a predetermined level larger than zero so as to reduce the noxious content, such as, CO, and HC in the engine exhaust gases.

According to a major feature of the present invention, there is provided an internal combustion engine of ignition timing controllable type for use with an automotive vehicle. The internal combustion engine comprises: an intake system including a carburetor having a throttle valve; a distributor; an ignition timing regulating device connected to the distributor and having a diaphragm chamber, to which a control vacuum is supplied; a first port from which a carburetor vacuum having relationship to the opening of the throttle valve is taken out; a second port from which an intake vacuum is taken out; and a first direction control valve operable in relationship to the speed of rotation of the internal combustion engine or to the running speed of the automotive vehicle. The first and second ports are selectively connected to the diaphragm chamber of the ignition timing regulating device by way of the first direction control valve, so that during a low speed driving condition of the internal combustion engine the intake vacuum taken out from the second port may be supplied to the diaphragm chamber to retard the ignition timing, so that during a high speed driving condition of the internal combustion engine a low carburetor vacuum taken out from the first port may be supplied to the diaphragm chamber to advance the ignition timing, and so that upon deceleration from a high speed driving condition a high carburetor vacuum taken out from the first port may be supplied to the diaphragm chamber to retard the ignition timing.

According to another feature of the present invention, there is provided an internal combustion engine, which additionally comprises: a valve opening maintaining device for maintaining the opening of the throttle valve higher than a predetermined level larger than zero; an actuating mechanism for the valve opening maintaining device having a diaphragm chamber; and a second direction control valve operative, in relationship to the speed of rotation of the internal combustion engine or to the running speed of the automotive vehicle, to selectively connect the diaphragm chamber of the actuating mechanism either to the first port or to atmospheric pressure, so that during the high speed driving condition of the internal combustion engine the atmospheric pressure may be supplied to the diaphragm chamber of the actuating mechanism to return the valve opening maintaining device to its operative condition.

BRIEF DESCRIPTION OF THE DRAWING

Other objects and advantages of the present invention will become apparent from the following description made in conjunction with the accompanying drawing, which is a diagrammatical presentation showing the construction of essential portions of the internal combustion engine according to the present invention.

DESCRIPTION OF THE PREFERRED EMBODIMENT

In the accompanying drawing, an intake system of the internal combustion engine includes a carburetor 1, and an intake pipe 2 connected to the downstream side of carburetor 1. A throttle valve 3 of the carburetor 1 is made to have its opening maintained higher than a predetermined level larger than zero by a valve opening maintaining device 4 of the conventional type, as shown diagrammatically. This valve opening maintaining device 4 includes a lever 6, which is supported in a rocking manner about a stationary shaft 5, and a stopper 7 attached to one end of the lever 6 is made operative to restrict the rocking motion of a lever 8 which in turn is attached to the throttle valve 3. The valve opening maintaining device 4 is actuated by a pneumatic actuating mechanism 10 through a rod 9 which is connected to the other end of the lever 6. This actuating mechanism 10 includes a housing 11, and a diaphragm 14 dividing the inside space of the housing 11 into two chambers 12 and 13 and connected to the rod 9. The chamber 12 is made to have communication, for example, with the atmosphere, while the chamber 13 is connected to an outlet port 17 of an electromagnetic three-way valve 16 by way of a conduit 15. This three-way valve 16 has its first inlet port 18 communicating with an air cleaner 20 by way of a conduit 19 and its second inlet port 21 communicating with a vacuum take-out port 23 of the intake pipe 2 by way of a conduit 22. A solenoid 25, which is operative to actuate a valve member 24 of the three-way valve 16, is electrically connected to an electric power source 27 by way of a switch 26 which is closed when the vehicle speed exceeds a predetermined value, for instance, 50km/hour.

An ignition timing regulating device 31 of the conventional type for a distributor 30 includes a housing 32, and a diaphragm 35, which divides the inside of the housing 32 into two chambers 33 and 34, is connected to a link 36 which is operative to move a braker plate of the distributor 30. This diaphragm 35 is held at its neutral position by springs 37 and 38, which are supported by the housing portions of the two chambers 33 and 34, respectively.

The chamber 33 of the housing 32 is connected by way of a conduit 39 to an outlet port 41 of an electromagnetic threeway valve 40 which has the same construction as that of the electromagnetic three-way valve 16. The three-way valve 40 has its first inlet port 42 communicating by way of a conduit 43 with a vacuum take-out port 44 which is open into the inside of the carburetor immediately downstream of the outer edge of the throttle valve 3 at its minimum opening position. The three-way valve 40 further has its second inlet port 45 communicating with the conduit 22 and the vacuum take-out port 23 of the intake pipe 2 by way of a conduit 46. A solenoid 49, which is operative to actuate a valve member 48 of the electromagnetic three-way valve 40, is electrically connected in parallel with the solenoid 25 of the electromagnetic three-way valve 16 by way of the switch 26.

The accompanying drawing shows the driving condition, in which the vehicle is driven by the internal combustion engine at a low speed, for example, less than 50 km/hour, with the switch 26 being inconductive, with the two electromagnetic three-way valves 16 and 40 being de-energized, and with their respective valve members 24 and 48 being located at the shown positions. The intake vacuum taken out from the vacuum take-out port 23 of the intake pipe 3 is supplied by way of the conduit 21, the communicating ports 21 and 17 of the electromagnetic three-way valve 16 and the conduit 15 to the chamber 13 of the pneumatic actuating mechanism 10, so as to turn clockwise the lever 6 of the valve opening maintaining device 4 through the rod 9, thus rendering the valve opening maintaining device 4 inoperative. Likewise, the intake vacuum taken out from the port 23 of the intake pipe 3 is supplied by way of the conduit 46, the communicating ports 45 and 41 of the electromagnetic threeway valve 40 and the conduit 39 to the chamber 33 of the ignition timing regulating device 31, so as to warp the diaphragm 35 in the leftward direction against the force of the spring 37 to thereby turn clockwise the braker plate of the distributor 30 through the link 36, thus retarding the ignition timing.

Under the condition in which the internal combustion engine is drive at a high speed, for example, greater than 50 km/hr., the switch 26 is closed to energize the two electromagnetic valves 16 and 40. Then, pressure of the level substantially equal to the atmospheric pressure is supplied from the air cleaner 20 into the chamber 13 of the pneumatic actuating mechanism 10 by way of the conduit 19, the communicating ports 18 and 17 of the electromagnetic three-way valve 16 and the conduit 15, so as to turn counter-clockwise the lever 6 through the rod 9, thus bringing the valve opening maintaining device 4 into an operative position. Since, on the other hand, the outer edge of the throttle valve 3 now in open condition is positioned downstream of the vacuum take-out port 44, pressure close to atmospheric pressure (or a low vacuum) is supplied from the vacuum take-out port 44 by way of the conduit 43, the communicating ports 42 and 41 of the electromagnetic valve 40 and the conduit 39 into the chamber 33 of the ignition timing regulating device 31, so as to warp the diaphragm in the rightward direction against the force of the spring 38 to thereby turn counterclockwise the braker plate of the distributor 30 through the link 36, thus advancing the ignition timing.

When the vehicle is decelerated from a high speed condition, the throttle valve 3 is closed to its minimum opening defined by the stopper 7 of the valve opening maintaining device 4 which remains effective. Then, the high vacuum at a portion downstream of the throttle valve 3 is supplied from the vacuum port 44 by way of the conduit 43, the ports 42 and 41 of the energized electromagnetic three-way valve 40 and the conduit 39 into the chamber 33 of the ignition timing regulating device 31, thus retarding the ignition timing.

When the engine speed is decreased to an extent to have a vehicle speed lower than 50 km/hour, the switch 26 is opened to de-energize the electromagnetic three-way valves 16 and 40. Then, the high intake vacuum, which is established due to the small opening of the throttle valve 3, is introduced from the port 23 by way of the conduit 22, the communicating ports 21 and 17 of the electromagnetic three-way valve 16 and the conduit 15 into the chamber 13 of the pneumatic actuating mechanism 10, so as to turn clockwise the lever 6, thus making the operation of the valve opening maintaining device 4 ineffective. As a result, the throttle valve 3 can be now closed completely, thus obtaining a sufficient braking effect on the engine. Likewise, the vacuum at the port 23 is introduced by way of the conduit 46, the communicating ports 45 and 41 of the electromagnetic three-way valve 40 and the conduit 39 into the chamber 33 of the ignition timing regulating device 31, thus succeedingly retarding the ignition timing.

As has been described above, it should be appreciated as an advantage of the present invention that during a low speed condition of the internal combustion engine, the ignition timing can be retarded to reduce the noxious content in the engine exhaust gases while during a high speed condition the ignition timing can be advanced to increase the power output. It should also be appreciated that upon deceleration from a high speed driving condition the ignition timing can be retarded to obtain a sufficient braking effect on the engine.

What is claimed is:

1. An internal combustion engine of ignition timing controllable type for use with an automotive vehicle, comprising: an intake system including a carburetor having a throttle valve; a distributor; an ignition timing regulating device connected to said distributor and having a diaphragm chamber, to which a control vacuum is supplied; a first port from which a carburetor vacuum having relationship to the opening of said throttle valve is taken out; a second port from which an intake vacuum is taken out; and a first direction control valve operable in relationship to one of the speed of rotation of the internal combustion engine and the running speed of the automotive vehicle, the first- and second-named ports being selectively connected to the diaphragm chamber of said ignition timing regulating device by the first-named direction control valve, so that during a low speed driving condition of the internal combustion engine the intake vacuum taken out from the second-named port may be supplied to said diaphragm chamber to retard the ignition timing, so that during a high speed driving condition of the internal combusiton engine a low carburetor vacuum taken out from the first-named port may be supplied to said diaphragm chamber to advance the ignition timing, and so that upon deceleration from a high speed driving condition a high carburetor vacuum taken out from the first-named port may be supplied to said diaphragm chamber to retard the ignition timing.

2. An internal combustion engine according to claim 1, wherein the first-named direction control valve comprises an electromagnetic valve adapted to be energized, when the engine speed is higher than a predetermined level, so as to connect the first-named port to the diaphragm chamber of said ignition timing regulating device.

3. An internal combustion engine according to claim 1, further comprising: a valve opening maintaining device for maintaining the opening of said throttle valve higher than a predetermined level larger than zero; an actuating mechanism for said valve opening maintaining device having a diaphragm chamber; and a second direction control valve operative, in relation to one of the speed of rotation of the internal combustion engine and the running speed of the automotive vehicle, to selectively connect the diaphragm chamber of said actuating mechanism to one of the first-named port and atmospheric pressure, so that during the high speed driving condition of the internal combustion engine the atmospheric pressure may be supplied to the diaphragm chamber of said actuating mechanism to return said valve opening maintaining device to its operative condition.

4. An internal combustion engine according to claim 3, wherein the second-named direction control valve comprises an electromagnetic valve adapted to be energized, when the engine speed is higher than a predetermined level, so as to connect the diaphragm chamber of said actuating mechanism to the atmosphere.

* * * * *